United States Patent [19]

Grossniklaus

[11] 4,385,569

[45] May 31, 1983

[54] APPARATUS FOR THE PREVENTION OF FIRE SPREADING WITHIN THE FEEDING CHANNEL LEADING INTO THE FIRE CHAMBER OF A FURNACE FOR SOLID FUEL

[76] Inventor: Hans Grossniklaus, Garage, 3855 Brienz, Switzerland

[21] Appl. No.: 311,867

[22] Filed: Oct. 15, 1981

[30] Foreign Application Priority Data

Oct. 17, 1980 [CH] Switzerland ..... 7760/80

[51] Int. Cl.[3] ..... F23D 1/00

[52] U.S. Cl. ..... 110/263; 110/297; 110/234; 110/261; 431/4; 431/190

[58] Field of Search ..... 110/263, 297, 218, 219, 110/262, 261, 234; 431/4, 190, 346

[56] References Cited

U.S. PATENT DOCUMENTS

| | | | |
|---|---|---|---|
| 169,338 | 11/1875 | Caldwell | 110/261 |
| 668,787 | 2/1901 | Vetillard et al. | 110/263 |
| 744,220 | 11/1903 | Neu | 110/260 |
| 2,353,144 | 7/1944 | Carrier | 236/42 |
| 3,183,864 | 5/1965 | Stengel | 431/4 |
| 3,748,080 | 7/1973 | Dunn | 431/4 |
| 3,861,857 | 1/1975 | Straitz | 431/4 |
| 3,994,671 | 11/1976 | Straitz | 431/4 |
| 4,079,778 | 3/1978 | Trump | 165/DIG. 2 |
| 4,094,632 | 6/1978 | Reed et al. | 431/4 |
| 4,114,682 | 9/1978 | Knud | 236/42 |
| 4,116,610 | 9/1978 | Berthiaume | 431/4 |
| 4,147,116 | 4/1979 | Graybill | 110/263 |
| 4,181,082 | 1/1980 | Grossniklaus | 110/293 |
| 4,204,463 | 5/1980 | Carty | 110/184 |
| 4,344,751 | 8/1982 | Chesters | 431/202 |

*Primary Examiner*—Henry C. Yuen

*Attorney, Agent, or Firm*—Brady, O'Boyle & Gates

[57] ABSTRACT

The furnace has a feeding channel (4) through which firewood is transported into a fire chamber (3). A steam pipe (10) leads into the channel (4). Through said pipe (10), steam is introduced into the solid fuel material in bursts as soon as a certain temperature is exceeded within the said channel (4). The steam increases the humidity in the air and the moisture of the firewood, thereby reliably preventing a spreading of the fire within the feeding channel (4), without simultaneously impairing combustion within the fire chamber (3).

8 Claims, 2 Drawing Figures

APPARATUS FOR THE PREVENTION OF FIRE SPREADING WITHIN THE FEEDING CHANNEL LEADING INTO THE FIRE CHAMBER OF A FURNACE FOR SOLID FUEL

BACKGROUND OF THE INVENTION

The invention relates to a method for the prevention of fire spreading inside the feeding channel leading into the fire chamber of a furnace for solid fuel and a furnace for the realization of this method.

The spreading of fire within the feeding channel can be prevented if it is made impossible for the flames to spread within the entire channel, across the section of the feeding channel which opens into the fire chamber proper.

U.S. Pat. No. 4,181,082 suggests that a fire inside the feeding channel of a furnace be extinguished by water. For this purpose, a water line is connected to the upper area of the feeding channel, which, at its point of connection, is closed by a valve which in turn is controlled by a temperature sensor. At a given temperature, this sensor opens the valve, permitting water to flow into the feeding channel, the water passing over the temperature sensor and lowering its temperature, causing the valve to close again as soon as the temperature has been lowered sufficiently. This method has the disadvantage that not only the fire inside of the feeding channel, but also the fire within the fire chamber will be extinguished, the fuel being fed into the fire chamber at that point being totally soaked. If the water flow should be reduced for the purpose of preventing the drenching of the fuel, the fire no longer will be extinguished with certainty, because only partial areas of the fuel will be wet. It is another disadvantage of this method of record that it creates a sump inside the feeding channel which can be removed only through cleaning.

It is the goal of the invention to prevent a spreading of the fire within the feeding channel without markedly impairing combustion inside the fire chamber.

SUMMARY OF THE INVENTION

The water vapor which is introduced into the feeding channel containing the solid fuel has two effects: First, it penetrates the entire fuel evenly, thereby increasing its moisture contents. Second, it increases the humidity of the air within the feeding channel. In doing so, the conditions favoring a spread of the fire within the feeding channel no longer prevail. Combustion inside of the fire chamber, however, is not, or at least not markedly impeded, inasmuch as the temperatures inside of the fire chamber are very high, and sufficient fresh air is being introduced so that moistened, but not soaked solid fuel burns very well.

If needed, the water vapor can be introduced continuously or periodically in bursts. Preferably, however, it is introduced only whenever the temperature inside of the feeding channel rises above a pre-set level. This is the case if the fire should attack the solid fuel material located at the end of the feeding channel and should begin to spread into the feeding channel itself. If wood should be used as fuel, for instance, this will be the case whenever the wood is very dry, so that the fire will spread more quickly than the wood can be introduced. If, however, freshly cut wood should be used, the spreading velocity (reduce combustion speed) of the fire will be less than the advancing speed of the wood, the fire will not spread into the feeding channel and the pre-set temperature will not be exceeded. By introducing water vapor only whenever the temperature rises above a certain level, only fuel material which is too dry will be moistened, whereas a sufficiently moist material, preventing a spread of the fire, will not unnecessarily be moistened still more.

Preferably, after the pre-set temperature has been exceeded, a small amount of water is evaporated in a burst. The amount of water is so selected as to merely prevent a spreading of the fire. For this purpose, it is sufficient to dampen the wood so that the spreading velocity of the fire is less than the flow of minimum fuel amounts required for the maintenance of the fire within the fire chamber, necessary for the continued operation of the plant, whenever no heat is required.

Using the enclosed drawings, the following is a description of a preferred embodiment of the invention.

DESCRIPTION OF THE PREFERRED EMBODIMENT

Figure 1:
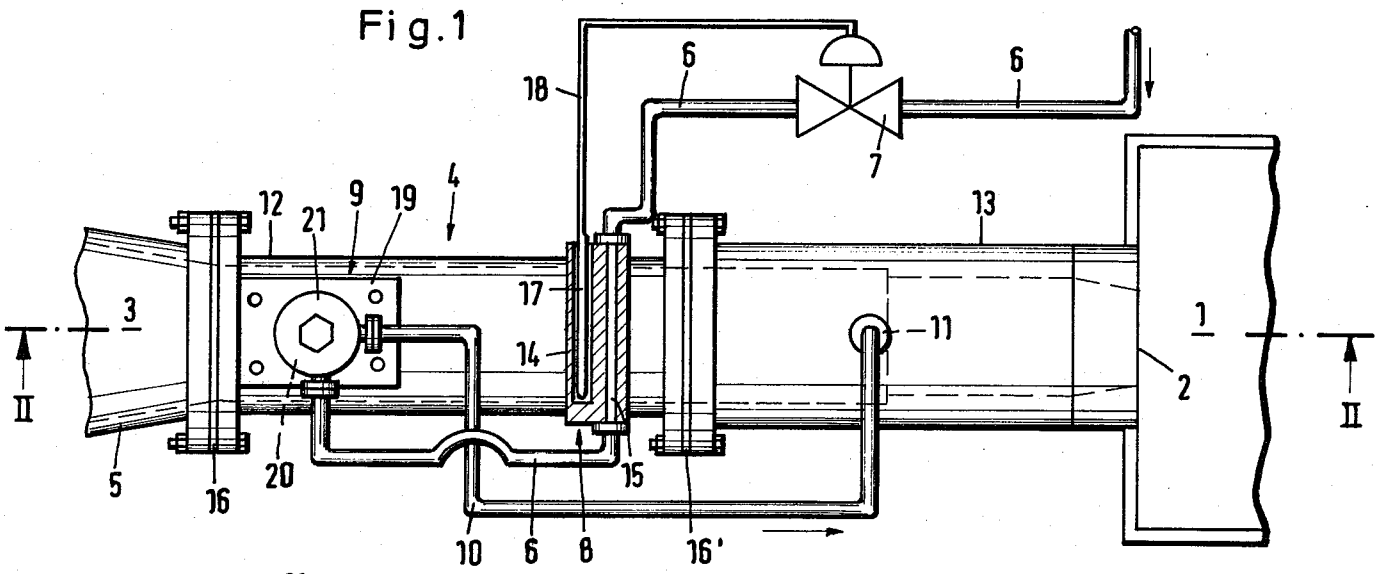
FIG. 1 is a top view of a furnace plant of the invention, partially in transverse section.
Figure 2:
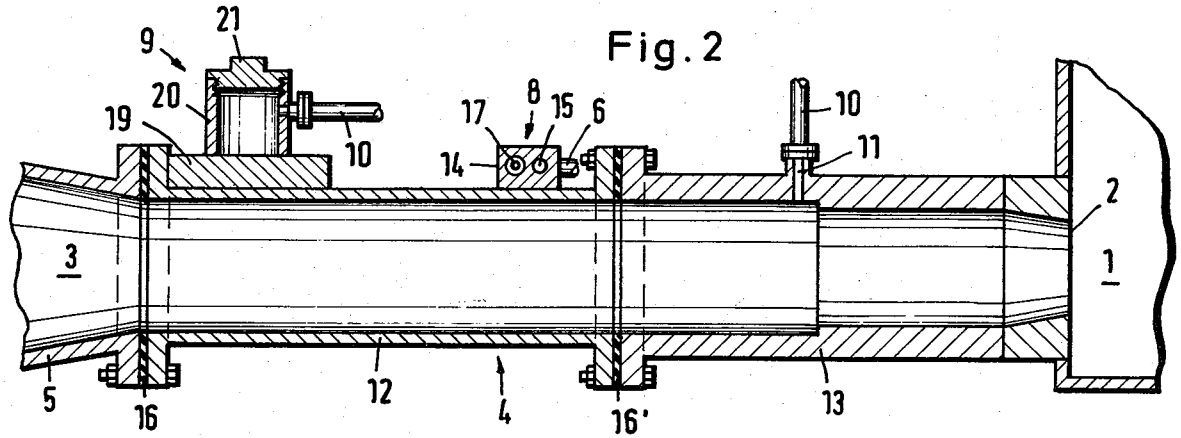
FIG. 2 is a vertical longitudinal section through the plant along line II—II in FIG. 1.

The plant shown is a wood furnace for a central heating plant with an automatic feeding mechanism for the fire chamber. It consists of a container 1 for the wood which, at the bottom of one of its lateral walls has an opening 2 which is reinforced around its edges, opening into a feeding channel 4, which in turn leads into the fire chamber 3. A ram (not shown) moving back and forth within the container 1 breaks the wood against the opening 2 and pushes it into the feeding channel 4. These steps are described in detail in U.S. Pat. No. 4,185,567. The fire chamber 3 is located within a combustion chamber 5 which is not shown in detail, but which is described in detail in U.S. Pat. No. 4,181,082.

A water pipe 6, connected to the water supply system, leads by way of a valve 7, operable by means of a pressure membrane, and by way of a heat exchanger 8 to another heat exchanger 9 in which the water is evaporated. A steam pipe 10 connected to the heat exchanger 9 transports the steam to an opening 11 in the wall of the rear of the two pipe sections 12, 13, which are forming the feeding channel 4.

Heat exchanger 8 is mounted on the rear end of the pipe section 12 which is flanged onto pipe section 13. It consists of a metal block 14, screwed onto the wall portion of pipe section 12, which metal block stores the heat transmitted by the wall of the pipe section, in turn transmitting it to the water which flows through its bore 15. The heat exchanger 9 is located on the front end of pipe section 12, which is flanged to the combustion chamber 5. It also has a metal block 19, screwed onto the wall of pipe section 12, and equally storing the heat transmitted by the wall of the pipe section. A pipe section 20 is welded onto the metal block 19, said pipe section being closed by a lid 21 which may be removed by unscrewing it. At a distance above the bottom of the heat exchanger 9 which is formed by the metal block 19, the water pipe 6 and the steam pipe 10 enter the upper portion of pipe section 20. By placing the connection bores for pipes 6 and 10 within the upper region of the pipe section 20, it is possible to avoid a clogging of the connecting bores by calcium deposits caused during the evaporation of the water introduced by water pipe 6 and settling on the metal block 19 in the lower portion of the pipe section 20. Lid 21 is removable so that the heat exchanger 9 can be cleaned, and the calcium deposit can be removed, respectively.

An asbestos intermediate ring 16,16' respectively is arranged between the flanges of the wall of the combustion chamber 5 and the pipe section 12, as well as between the two pipe sections 12,13. The asbestos ring 16 prevents the pipe section 12 from heating up too much because of heat conduction from the wall of the combustion chamber 5, furthering the spreading of the fire into pipe section 12. Asbestos ring 16' prevents the rear end of the pipe section 12 cooling down too much because of heat conduction into pipe section 13, thereby impeding the operation of the heat exchanger 8, as described in the following.

While a temperature increase of the water within the heat exchanger 8 is desirable, since it does enable the heat exchanger 9 to more quickly heat the water to boiling temperature and cause it to evaporate, it is not the essential purpose of heat exchanger 8. The latter does cooperate with an expansion-temperature sensor 17 and the membrane valve 7 in such a manner that the latter opens as soon as a certain temperature has been reached and re-closes after letting a certain amount of water pass. For this purpose, the container with the expansion liquid of the said temperature sensor 17 is located in a second bore of the heat exchanger block 14, running parallel to a first bore 15. A capillary tube 18 connects the sensor 17 with the membrane valve 7, causing it to open after a pre-set temperature has been exceeded and to close again as soon as the temperature has fallen below the pre-set point. Inasmuch as the heat exchanger 8 is being cooled by the water flowing through it, the drop in temperature causing the closing of valve 7 takes place after a certain amount of water has flowed through the heat exchanger 8.

The device operates as follows:

The ram located within the container 1, with its operating lift, pushes the firewood towards the opening 2, crushes it and pushes the smashed wood forward and into the feeding channel 4. The operating speed of the ram and, therefore, the flow of firewood is controlled in dependence from the heat requirements of the central heating plant, a minimum flow of fuel being maintained to guarantee a continued fire within the fire chamber 3. As long as damp wood is introduced, and given the minimum fuel flow, the fire cannot spread from the fire chamber 3 into the feeding channel 4. The pipe section 12 is not heated and the temperature monitored by the temperature sensor 17 of the heat exchanger 8 remains below the pre-set temperature, so that valve 7 also remains closed and no steam is introduced. If, however, dry wood is introduced, the reverse combustion speed, i.e. the velocity with which the fire spreads against the advancing fuel supply speed, may become greater than the speed of the material within the feeding channel. In this case, the fire will attack the wood at the outlet of the feeding channel 4, thereby increasing the temperature at the end of pipe section 12 and of the superimposed heat exchanger 9 to more than 200° C. The heat conductivity of the pipe section 12 causes the heat exchanger 8 and thereby the temperature sensor 17 to be heated up. The expansion liquid contained within the latter does, in expanding and passing the limit of the pre-set temperature, trigger the membrane of valve 7. Valve 7 opens and the water flowing through pipe 6 absorbs heat from the heat exchanger 8 and, in the heat exchanger 9 is heated to above boiling and is evaporated in bursts. The water vapor (wet steam) flows through the steam pipe 10 and opening 11 into the rear pipe section 13, and then spreads throughout the entire feeding channel 4, increasing the humidity of its air and penetrating the crushed wood. After a certain amount of water (20 to 30 $cm^3$) has passed through the heat exchanger 8, the temperature of the latter, and thus also the temperature of the temperature sensor 17 will have dropped, the expansion liquid contracts and valve 7 closes once again. Because only a relatively small amount of water reaches the heat exchanger 9, the required evaporation temperature is relatively low, and the heat exchanger 9 is only minimally cooled down. Should the burst of steam introduced be insufficient for the prevention of a spreading fire, by supply insufficient moisture to the air and the wood, i.e. if the fire continues, the heat exchanger 8 is reheated to the pre-set temperature by the heat transmitted by pipe section 12, causing a new burst of steam to be created in the manner as described above. This process is repeated until the fire at the outlet of the feeding channel 4 has been reduced to a low level in which very little heat is generated and the reverse combustion speed is lower than the advancing speed of the minimum supply of fuel necessary for the maintenance of the fire within the fire chamber 3. Inasmuch as, at that point, all of the firewood contained in the feeding channel is highly moisturized, the danger of a spreading fire does not exist until new firewood has been transported from the container 1 as far as the end of the feeding channel 4. At that time, and if needed, the dampening procedure as described is repeated.

The increased moisture contents of the firewood does not impair combustion within the fire chamber 3, since the temperature there is very high and there is a steady flow of fresh air to aid in the combustion.

The method of the invention is especially suited for use in wood furnaces of the above described type, in which crushed wood is used, because the steam easily penetrates the air pockets created by the smashing of the wood, thereby effectively moistening it through and through. The application of this method, however, is not limited to wood furnaces. For instance, this method is equally well suited for convention wood furnaces, using wood which has been cut down to small pieces by means of a suitable apparatus, and the wood then being transported into the fire room by means of a spiral conveyor arranged within a feeder pipe. In addition to wood, other solid fuel, such as, for instance, coal can be used, but in the case of wood, however, the problem of spreading fire is pronounced, since the moisture content of the wood used fluctuates greatly.

Steam generation within the heat exchanger 9 has the advantage that any heat lost by a fire at the outlet of the feeding channel can be utilized for the steam generation. It is understood that the steam could also be generated by means of a vaporizer which could be heated electrically, like, for instance, by a steam boiler.

Using the heat exchanger 8, the temperature sensor 17 and the valve activated by the latter, and the simplest of methods, a definite, small and pre-warmed amount of water is fed into the heat exchanger 9 as soon as the pre-set temperature is exceeded, and the water is turned into steam in bursts. If a larger amount of water should have to be converted into steam, the temperature sensor 17 or a control device connected with said sensor, respectively, could open the valve 7 as soon an upper temperature limit would be passed, not closing it until a considerable drop in temperature had taken place, dropping the temperature beneath a lower limit. The amount of water used for the generation of steam could also be metered in a different manner. For instance, a timer could be provided to keep the valve, after its opening had been triggered by a temperature sensor, open for a period of time corresponding to the desired amount of water to be used.

The introduction of the steam pipe 10 into the rear portion 13 of the feed channel guarantees an even distribution of the steam throughout the entire channel. If the introductory pipe 10 were to open into the end of the feeding channel 4 which connects to the combustion chamber 5, it could be possible that part of the steam might escape into the fire chamber 3. The arrangement of the steam inlet 11 within the rear portion of channel 13—at a distance which is a multiple of the channel diameter from the fire chamber—guarantees also that the fire, even if it should explosively spread into the front area of the feeding channel—cannot spread throughout the entire channel area, because in a rapid sequence bursts of steam would occur, affecting the wood which is located in the rear areas and not yet on fire, dampening it to such a degree that a continued expansion of the fire would be impossible. There is also the possibility of providing a nozzle at the outlet of opening 11, in order to distribute the steam in the feeding channel with still greater speed. In addition, several steam pipes could be provided for very long feeding channels, or, as an alternative, one steam line could have several openings into the feeding channel, in order to supply steam to its entire length.

The heat exchanger 8 can be omitted if the temperature sensor 17 is arranged within a bore of the metal block 19 of the heat exchanger 9, the latter being mounted to the feeding channel 4. On the other hand, the heat exchanger 8 with the temperature sensor 17 could be mounted to the front end of the feeding channel 4 and the heat exchanger 9 could be fastened to or within the combustion chamber 5.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A furnace comprising a fire chamber (3), a feeding channel (4) for solid fuel opening into said fire chamber, feeding means for feeding said fuel through said feeding channel (4) into said fire chamber (3), a steam pipe (10) opening (11) into the said feeding channel (4) for introducing water vapor into said solid fuel present within said feeding channel (4), a water supply pipe (6), a heat exchanger (9) connecting said water pipe (6) with said steam pipe (10), said heat exchanger (9) connected adjacent the fire chamber for the purpose of evaporating water from the water pipe (6) by means of combustion heat transmitted by the said heat exchanger (9), control means (7) for controlling the feed of said water vapor including a temperature sensor (17), arranged at said feeding channel (4), said control means (7) releasing the feed of said water vapor only if a pre-set temperature in the feeding channel (4) has been exceeded, said pre-set temperature indicating a spreading of the fire out of the fire chamber (3) into said feeding channel (4), said control means including a closing means (7) connected in the water pipe (6) to control the supply of water in said water pipe to be evaporated, and said temperature sensor (17) connected to control said closing means (7) in such a manner that said closing means (7) opens in response to a sensed temperature above a pre-set temperature and closes below the said pre-set temperature, the temperature sensor (17) being located in a second heat exchanger (8), arranged at the feeding channel (4) and connected into the water pipe (6), causing the flowing water, after the opening of the closing means (7), to cool down the second heat exchanger (8) to a temperature triggering the closing of the closing means (7) after a certain amount of water has passed through.

2. A furnace as defined in claim 1, in which the second heat exchanger (8) is located in the water pipe (6), before the first mentioned heat exchanger (9), seen in the direction of the flow, and said second heat exchanger being arranged at the feeding channel (4) at a distance from the said first heat exchanger (9), as well as at a distance from the entrance to the fire chamber (3).

3. A furnace as defined in claim 1, in which said steam pipe (10) enters the feeding channel (4) at a distance from the fire chamber (3), the distance of the opening (11) from the entrance to the fire chamber preferably being a multiple of the clear width of the feeding channel (4).

4. A furnace as defined in claim 1 in which said heat exchanger (9) is connected at the end of the feeding channel (4) opening into said fire chamber (3).

5. A furnace as defined in claim 1 in which said closing means (7) closes after a pre-set temperature drop below the said pre-set temperature.

6. A furnace comprising a fire chamber (3), a feeding channel (4) for solid fuel opening into said fire chamber, feeding means for feeding said fuel through said feeding channel (4) into said fire chamber (3), a steam pipe (10) opening (11) into the said feeding channel (4) for introducing water vapor into said solid fuel present within said feeding channel (4), a water supply pipe (6), a heat exchanger (9) connecting said water pipe (6) with said steam pipe (10), said heat exchanger (9) connected adjacent the fire chamber for the purpose of evaporating water from the water pipe (6) by means of combustion heat transmitted by the said heat exchanger (9), control means (7) for controlling the feed of said water vapor including a temperature sensor (17), arranged at said feeding channel (4), said control means (7) releasing the feed of said water vapor only if a pre-set temperature in the feeding channel (4) has been exceeded, said pre-set temperature indicating a spreading of the fire out of the fire chamber (3) into said feeding channel (4), said control means including a closing means (7) connected in the water pipe (6) to control the supply of water in said water pipe to be evaporated, and said temperature sensor (17) connected to control said closing means (7) in such a manner that said closing means (7) opens in response to a sensed temperature above a pre-set temperature and closes after a pre-set time interval, the temperature sensor (17) being located in a second heat exchanger (8), arranged at the feeding channel (4) and connected into the water pipe (6), causing the flowing water, after the opening of the closing means (7), to cool down the second heat exchanger (8), the closing means (7) closing after a certain amount of water has been passed through.

7. A furnace comprising a fire chamber (3), a feeding channel (4) for solid fuel opening into said fire chamber, feeding means for feeding said fuel through said feeding channel (4) into said fire chamber (3), a steam pipe (10) opening (11) into the said feeding channel (4) for introducing water vapor into said solid fuel present within said feeding channel (4), a water supply pipe (6), a heat exchanger (9) connecting said water pipe (6) with said steam pipe (10), said heat exchanger (9) connected adjacent the fire chamber for the purpose of evaporating water from the water pipe (6) by means of combustion heat transmitted by the said heat exchanger (9), control means (7) for controlling the feed of said water vapor including a temperature sensor (17), arranged at said feeding channel (4), said control means (7) releasing the feed of said water vapor only if a pre-set temperature in the feeding channel (4) has been exceeded, said pre-set temperature indicating a spreading of the fire out of the fire chamber (3) into said feeding channel (4), said control means including a closing means (7) connected in the water pipe (6) to control the supply of water in said water pipe to be evaporated, and said temperature sensor (17) connected to control said closing means (7) in such a manner that said closing means (7) opens in response to a sensed temperature above a pre-set temperature and closes below the said pre-set temperature, the temperature sensor (17) being located in the heat exchanger arranged at the feeding channel (4) and connected into the water pipe (6), causing the flowing water, after the opening of the closing means (7), to cool down the heat exchanger to a temperature triggering the closing of the closing means (7) after a certain amount of water has been evaporated.

8. A furnace comprising a fire chamber (3), a feeding channel (4) for solid fuel opening into said fire chamber, feeding means for feeding said fuel through said feeding channel (4) into said fire chamber (3), a steam pipe (10) opening (11) into the said feeding channel (4) for introducing water vapor into said solid fuel present within said feeding channel (4), a water supply pipe (6), a heat exchanger (9) connecting said water pipe (6) with said steam pipe (10), said heat exchanger (9) connected adjacent the fire chamber for the purpose of evaporating water from the water pipe (6) by means of combustion heat transmitted by the said heat exchanger (9), control means (7) for controlling the feed of said water vapor including a temperature sensor (17), arranged at said feeding channel (4), said control means (7) releasing the feed of said water vapor only if a pre-set temperature in the feeding channel (4) has been exceeded, said pre-set temperature indicating a spreading of the fire out of the fire chamber (3) into said feeding channel (4), said control means including a closing means (7) connected in the water pipe (6) to control the supply of water in said water pipe to be evaporated, and said temperature sensor (17) connected to control said closing means (7) in such a manner that said closing means (7) opens in response to a sensed temperature above a pre-set temperature and closes after a pre-set time interval, the temperature sensor (17) being located in the heat exchanger, arranged at the feeding channel (4) and connected into the water pipe (6), causing the flowing water, after the opening of the closing means (7), to cool down the heat exchanger, the closing means (7) closing after a certain amount of water has been passed through.

* * * * *